US006907649B2

(12) United States Patent
Yamada

(10) Patent No.: US 6,907,649 B2
(45) Date of Patent: Jun. 21, 2005

(54) SETTING APPARATUS FOR NUT-TYPE FASTENER SUCH AS BLIND NUT

(75) Inventor: Hiroyuki Yamada, Toyohashi (JP)

(73) Assignee: Newfrey LLC, Newark, DE (US)

( * ) Notice: Subject to any disclaimer, the term of this patent is extended or adjusted under 35 U.S.C. 154(b) by 13 days.

(21) Appl. No.: 10/726,784

(22) Filed: Dec. 3, 2003

(65) Prior Publication Data

US 2004/0168289 A1 Sep. 2, 2004

(30) Foreign Application Priority Data

Dec. 13, 2002 (JP) ..... 2002-361899

(51) Int. Cl.[7] ..... B21D 9/05; B21J 15/22; B25B 27/00

(52) U.S. Cl. ..... 29/243.526; 29/243.521; 29/243.525; 72/114; 72/391.8

(58) Field of Search ..... 29/243.521, 243.525, 29/243.526; 72/114, 391.8

(56) References Cited

U.S. PATENT DOCUMENTS

| | | | | |
|---|---|---|---|---|
| 3,555,649 A | * | 1/1971 | Rigot et al. | 72/391.8 |
| 4,571,976 A | * | 2/1986 | Schwab | 72/391.8 |
| 4,612,793 A | * | 9/1986 | Klein | 72/391.8 |
| 6,212,931 B1 | * | 4/2001 | Solfronk | 72/391.8 |
| 6,272,899 B1 | | 4/2001 | Solfronk | |

FOREIGN PATENT DOCUMENTS

| | | |
|---|---|---|
| EP | 787 563 A1 | 8/1997 |
| JP | 51-142171 | 12/1976 |
| JP | 58-162312 | 10/1983 |
| JP | 58-186208 | 10/1983 |
| JP | 63-35809 | 3/1988 |
| JP | 63-52974 | 3/1988 |
| JP | 1-84842 | 6/1989 |
| JP | 2001-510733 | 8/2001 |

* cited by examiner

*Primary Examiner*—David Jones
(74) *Attorney, Agent, or Firm*—Harness, Dickey & Pierce, P.L.C.

(57) ABSTRACT

A setting apparatus 1 for setting a blind nut or the like to a workpiece, comprises a mandrel 7, a hydraulic cylinder 17 receiving therein a hydraulic piston 15 for axially pulling the mandrel 7, an oil reservoir 22 for containing oil to be supplied to the hydraulic cylinder 17, and an air cylinder 27 for receiving therein an air piston 26 connected to a ram 25 adapted to be reciprocatingly advanced and retracted in the oil reservoir 22. In response to the compressed air supplied to the air cylinder, the hydraulic piston 15 is moved to pull the mandrel 7, whereby a fastener threadedly connected with the mandrel is set to a workpiece. The setting apparatus 1 also includes an air-pressure setting valve 33 for adjustably presetting the air pressure of the compressed air to be supplied to the air cylinder 27. When the air pressure in said air cylinder reaches the preset air pressure level, the air-pressure setting valve 33 is operated to feed the compressed air from the air cylinder to completion valve activation assembly 13 so that a completion valve 11 is activated to stop the movement of the air piston 26 to prevent the mandrel 7 from being pulled.

5 Claims, 5 Drawing Sheets

SETTING APPARATUS FOR NUT-TYPE FASTENER SUCH AS BLIND NUT

FIELD OF THE INVENTION

The present invention relates to a setting apparatus for setting a nut-type fastener, such as a blind nut or a press nut, the fastener having a hollow internally threaded tubular body with one end formed with a flange or a larger diameter portion, to a workpiece, such as a panel.

BACKGROUND OF THE INVENTION

There has been well known a blind nut as disclosed, for example, Japanese Utility Model Laid-Open No. 58-186208 (Publication 1, see, particularly, FIG. 2B). The blind nut is formed as a hollow internally threaded tubular body with one end having a flange, using a plastically deformable material such as metal. The tubular portion of the blind nut is inserted into a mounting hole of a workpiece to bring the flange into surface contact with the workpiece and cause buckling in a part of the tubular portion. In this way, the blind nut is fixed to the workpiece while clamping the workpiece between the buckled portion and the flange. The blind nut is conveniently set to a workpiece, such as a large panel, having difficulty in accessing to the backside thereof, because such a setting operation can be performed from one side. A bolt can be screwed into the blind nut fixed to the workpiece to allow an additional component to be attached to the workpiece through the bolt. A press nut has also been known as one of nut-type fasteners other than the blind nut. For example, one press nut is disclosed in Japanese Utility Model Laid-Open No. 63-35809 (Publication 2). Typically, the body of the press nut has one end formed with an insertion portion to be inserted into a mounting hole of a workpiece, and the insertion portion is forcedly inserted into the mounting hole to fix the press nut to the workpiece.

A blind-nut setting apparatus is used in the operation of setting a blind nut to a workpiece. A conventional blind-nut setting apparatus is disclosed, for example, in Japanese Patent Laid-Open Nos. 51-142171 (Publication 3), and 63-52974 (Publication 4: Japanese Patent Publication No. 4-789), Japanese Utility Model Laid-Open No. 1-84842 (Publication 5: Japanese Utility Model Publication No. 3-35464) and Japanese Patent Laid-Open No. 2001-510733 (Publication 6). While these conventional blind-nut setting apparatus are different from each other in their detailed structure, they are commonly constructed by utilizing an air pressure and an oil pressure for intensifying the air pressure. The blind-nut setting apparatus has a basic structure comprising: a nose having a mandrel which is disposed at the front end thereof and formed with an externally thread to be threadedly connected with a blind nut; a hydraulic cylinder for receiving therein a hydraulic piston for axially pulling the mandrel; and a handle portion having an oil reservoir formed therein for containing oil to be supplied to the hydraulic cylinder, and an air cylinder for receiving therein an air piston to allows a ram connected to the air piston to be reciprocatingly advanced and retracted in the oil reservoir. In this structure, upon triggering, compressed air is supplied to the air cylinder to move the air piston to advance the ram in the oil reservoir to thereby supply oil from the oil reservoir to the hydraulic cylinder so that the hydraulic piston is moved to pull the mandrel, whereby the blind nut threadedly connected with the mandrel is set to the workpiece.

The blind-nut setting apparatuses disclosed in the above Patent Publications 3 to 6 are advantageous in that upon triggering after supplying of compressed air from outside, a blind nut threadedly connected with the mandrel is desirably set to a workpiece, such as a panel, at a desired fixing force. In an operation of setting a blind nut to various workpieces different in thickness using the conventional blind-nut setting apparatuses including the above blind-nut setting apparatuses, the pulling length (stroke) of the mandrel is changed according to the variations in thickness. For example, if a workpiece is changed from a thin panel to a thick panel (or multiple panels), the setting operation has been completed by moving the mandrel over a shorter pulling length (stroke), and thus, the mandrel must be adjusted to have a shorter stroke. When such a setting apparatus required for managing a setting force by adjusting the stroke of the mandrel is used to set a blind nut to a workpiece having a non-uniform or large variation in thickness (e.g. FRP: Fiber Reinforced Plastic), an adequate setting force can be obtained only if the stroke of the mandrel is adjusted in compliance with the variation in thickness of the workpiece on a case-by-case basis.

SUMMARY OF THE INVENTION

It is therefore an object of the present invention to provide a setting apparatus capable of adequately setting a nut-type fastener, such as a blind nut, to a workpiece irrespective of the variation in thickness of the workpiece.

In order to achieve the above object, the present invention provides a fastener setting apparatus for setting, to a workpiece, a nut-type fastener such as a blind nut which is formed as a hollow internally threaded tubular body with one end having a flange or a larger diameter portion. The fastener setting apparatus comprises: a mandrel adapted to be screwed into the fastener; a hydraulic cylinder for receiving therein a hydraulic piston for axially pulling the mandrel; an oil reservoir for containing oil to be supplied to the hydraulic cylinder; a ram reciprocatably disposed in the oil reservoir; an air cylinder for receiving therein an air piston which allows the ram connected thereto to be reciprocatingly advanced and retracted in the oil reservoir, wherein upon triggering, compressed air is supplied to the air cylinder to move the air piston to advance the ram into the oil reservoir to thereby supply oil from the oil reservoir to the hydraulic cylinder so that the hydraulic piston is moved to pull the mandrel, whereby the fastener threadedly connected with the mandrel is set to the workpiece. The fastener setting apparatus further comprising: an air-pressure setting valve for adjustably presetting the air pressure of the compressed air to be supplied in the air cylinder and applied to the air piston; a completion valve operable to discharge the compressed air from the air cylinder outside to stop the movement of the hydraulic piston; and completion valve activation assembly for enabling the completion valve to be operated. When the air pressure in the air cylinder reaches the preset air pressure level, the air-pressure setting valve is operated to feed the compressed air from the air cylinder to the completion valve activation assembly so as to stop the hydraulic piston from axially pulling the mandrel at the preset air pressure.

According to the above fastener setting apparatus, when the air pressure in the air cylinder reaches the preset air pressure level, the air-pressure setting valve feeds the compressed air from the air cylinder to the completion valve activation assembly to activate the completion valve so as to stop the hydraulic piston from axially pulling the mandrel. Thus, the need for adjusting the stroke of the mandrel can be eliminated. Further, since the pulling force of the mandrel can be maintained at a constant level even if a workpiece has a different thickness, a fastener such as a blind nut can be adequately set to a workpiece only by presetting the air pressure at a level corresponding to a setting force for the workpiece once (or by only a single adjustment) irrespective of the variation in thickness of the workpiece. The pulling force of the mandrel is directly reflected to the setting force to allow the setting force to be stably maintained at a high level. Furthermore, instead of the adjustment of the ram or the oil pressure in the oil reservoir, the adjustment based on the air pressure in the air cylinder makes it possible to provide a facilitated adjusting operation and a simplified adjustment mechanism.

In the above fastener setting apparatus, the air-pressure setting valve may includes: a valve element; a valve housing for receiving the valve element therein and having an inlet in fluid communication with the air cylinder; a spring for pressing the valve element against the inlet with a certain spring force to prevent the compressed air in the air cylinder from being discharged; and a spring holder attached to the valve housing for holding the spring and having an outlet for releasing the compressed air, the spring holder being attached to the valve housing in such a manner that the pressing force of the spring can be changed, whereby the air pressure to be supplied to the air cylinder is preset according to the change of the pressing force of the spring.

The above completion valve activation assembly may include a cylinder for receiving the compressed air from the air-pressure setting valve, and a completion valve activating piston for moving the completion valve to its activated position, wherein a check valve is arranged in parallel with the air-pressure setting valve to discharge the compressed air remaining in the cylinder of the completion valve activation assembly to the air cylinder after the completion of the operation of the completion valve activation assembly, so as to return the completion valve activating piston to its initial position.

The fastener setting apparatus may further include: an air motor adapted to rotate the mandrel about its axis in a forward direction to allow the nut-type fastener to be threadedly connected with the mandrel and in a reverse direction to allow the threadedly connected fastener to be disengaged from the mandrel, wherein the completion valve is operable in its initial position to rotate the air motor in the forward direction, and operable in the activated position to rotate the air motor in the reverse direction, wherein when the air pressure onto the air piston reaches the preset air pressure level, the completion valve is moved to the activated position to rotate the air motor in the reverse direction so that the fastener threadedly connected with the mandrel is disengaged therefrom. The fastener may be a blind nut or a press nut.

DETAILED DESCRIPTION OF THE PREFERRED EMBODIMENT

Figure 1:
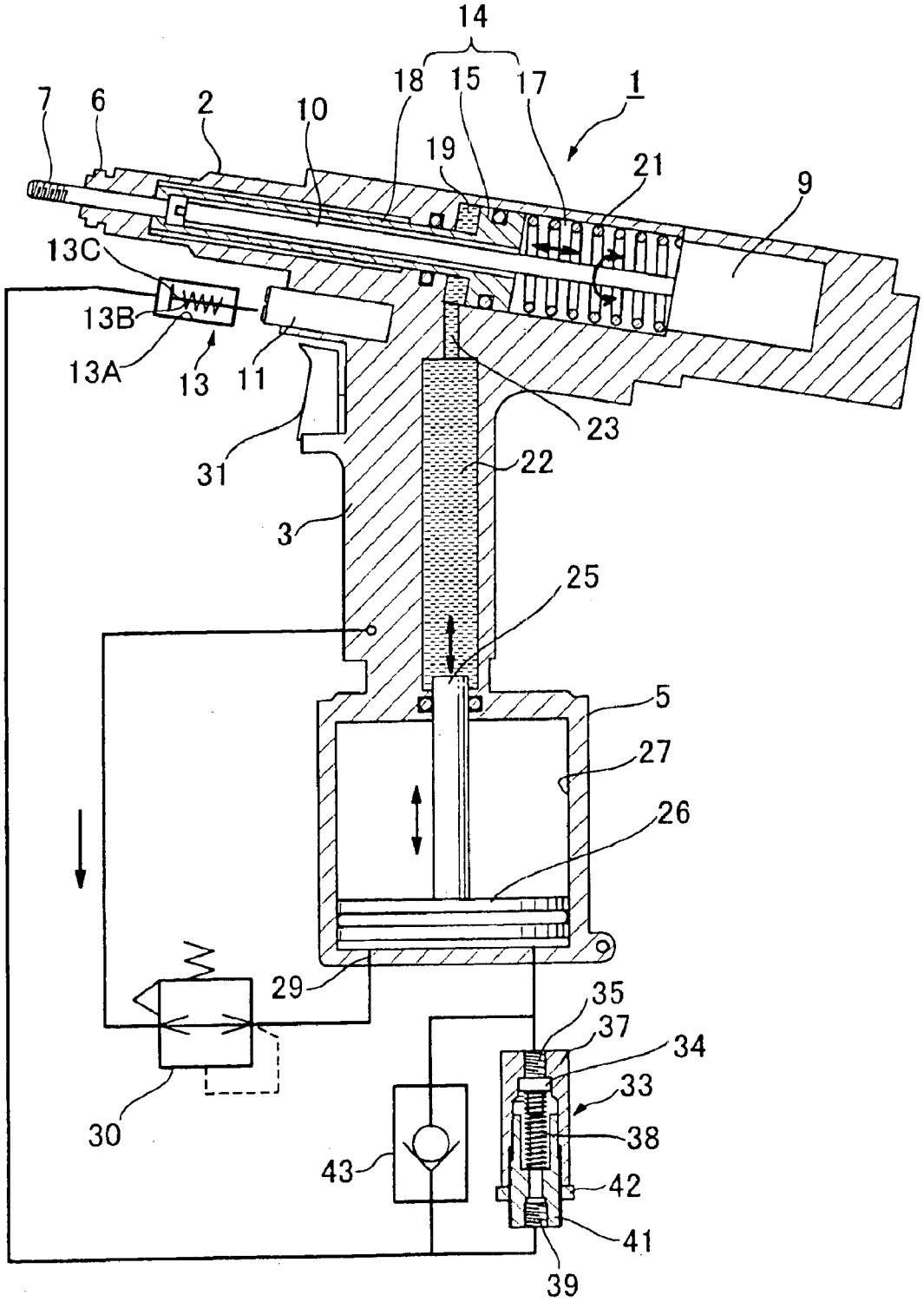
FIG. 1 is a block diagram of a fastener setting apparatus according to the present invention.

With reference to the drawings, one embodiment of the present invention will now be described. FIG. 1 is a schematic sectional view showing a setting apparatus for nut-type fasteners such as blind nuts according to one embodiment of the present invention. The setting apparatus 1 comprises an elongated tool housing 2, a handle 3 extending from the intermediate portion of the tool housing 2 at an appropriate angle therewith to allow an operator to grip the handle 3, and an air cylinder section 5 provided at the bottom of the handle 3. Compressed air is supplied from a compressor or the like to the setting apparatus 1, for example, by coupling a hose (not shown) to the handle 3. As illustrated, a mandrel 7 is formed with an external thread to be threadedly connected with a blind nut having an internal thread formed therein and the mandrel 7 extends from a nose 6 at the front end of the tool housing 2. The mandrel 7 is connected to a rotation rod 10 extending through the inner space of the tool housing 2 from the nose 6 to an air motor 9 at the rear end of the tool housing 2, and can be axially rotated by the air motor 9 as driving means. When the air motor 9 is supplied with the compressed air, it can rotate the mandrel 7 about its axis in a forward direction allowing a fastener to be threadedly connected with the mandrel 7 and in a reverse direction allowing the threadedly connected fastener to be disengaged from the mandrel 7. The compressed air is supplied to the air motor 9 through a completion valve 11 for changing the operation of the air motor between the positive and reverse rotation conditions . The completion valve 11 is moved between its initial position allowing the air motor 6 to be rotated in the forward direction and its activated position allowing the air motor 6 to be rotated in the reverse direction, and is normally in the initial position. When a fastener such as a blind nut is pressed against the mandrel 7 to push the mandrel into the nose 6, the compressed air is supplied to the air motor 9 through the completion valve 11 which is in the initial position. Thus, the mandrel 7 is rotated in the forward direction, and threadedly connected with the fastener. As the mandrel is screwed into the fastener to bring the fastener into contact with the end surface of the nose, the fastener acts to return the mandrel 7 gradually to its protruded position from the nose. When the mandrel 7 is again returned to its protruded position from the nose 6 to a predetermined length, the supply of the compressed air to the air motor 9 is discontinued, and then the air motor 9 is stopped while maintaining the threaded connection between the fastener and the mandrel 7. When the setting apparatus is operated by pulling the trigger, the completion valve 11 is moved or changed from the initial position to the activated position by a completion valve activation assembly 13. The completion valve activation assembly 13 comprises a cylinder 13A for receiving compressed air from an air-pressure setting valve 33 (discussed later), and a completion valve activating piston 13C for pressingly moving the completion valve 11 to its activated position against the biasing force of a spring 13B according to the received compressed air. When the completion valve activating piston 13C moves the completion valve 11 to the activated position, the completion valve 11 feeds the compressed air to the air motor 9 to rotate the air motor 9 in the reverse direction. Thus, the rotation rod 10 is rotated in the reverse direction, and the fastener threadedly connected with the mandrel 7 is disengaged therefrom. Simultaneously, the supply of the compressed air to an air cylinder 27 (described later) is also discontinued.

The tool housing 2 is provided with a hydraulic actuating assembly 14 for pulling the rotation rod 10 axially rearward to pull the mandrel 7 at the front end of the rotation rod 10 toward the nose 6 of the tool housing 2, without interfering with the axial rotation of the rotation rod 10 connected to the mandrel 7. The hydraulic actuating assembly 14 comprises a hollow hydraulic piston 15 having a through hole for receiving the rotation rod 10 therethrough without interfering with the rotation of the rotation rod 10; a hydraulic cylinder 17 for receiving therein the hydraulic piston 15 while allowing the hydraulic piston 15 to be moved rearward; and a hollow pulling rod 18 extending from the hydraulic piston 15 toward the nose 6 and having a through hole for receiving the rotation rod 10 therethrough without interfering with the rotation of the rotation rod 10. The pulling rod 18 is coupled with the rotation rod 10 in such a manner that it surrounds a larger diameter portion formed at the front end of the rotation rod 10 to pull the rotation rod 10 axially rearward to pull the mandrel 7 connected to the rotation rod 10 into the nose 6 of the tool housing 2. A hydraulic chamber 19 defined between the hydraulic cylinder 17 and the surface of the hydraulic piston 15 on the side of the nose 6 is filled with pressurized oil. Upon introducing pressurized oil into the hydraulic chamber 19, the hydraulic piston 15 is moved rearward within the tool housing 2. When the introduction of the pressurized oil to the hydraulic chamber 19 is discontinued, the hydraulic piston 15 is returned toward the front end of the tool housing 2 by a spring 21 provided between the hydraulic piston 15 and the rear wall of the hydraulic cylinder 17.

The pressurized oil to be introduced into the hydraulic chamber is supplied from an oil reservoir 22 formed in the inside of the handle 3, through a passage 23. The oil reservoir 22 is formed as a cylinder extending in the longitudinal direction of the handle 3 to contain the oil. A rod-shaped ram 25 is disposed at the lower portion of the reservoir 22 in such a manner that the ram is reciprocatingly advanced and retracted in the longitudinal direction of the cylinder-shaped oil reservoir. When the ram 25 is advanced in the oil reservoir 22, the working oil in the oil reservoir 22 is pressurized and supplied into the hydraulic chamber 19 of the hydraulic cylinder 17. The ram 25 also serves as a piston rod of an air piston 26 received in the air cylinder section 5 provided at the bottom of the handle 3. The ram 25 is moved vertically in conjunction with the vertical movement of the air piston 26. The air piston 26 is vertically moved within the air cylinder 27 which formed in the inside of the air cylinder section 5. The air cylinder 27 is formed as a cylinder-shaped chamber having a relatively large diameter to allow the air piston 26 to have a relatively large pressure-receiving area capable of receiving an air pressure enough to move the air piston 26 against the oil pressure applied to the ram 25 in the oil reservoir 22. The bottom wall of the air cylinder 27 is formed with the compressed air inlet 29 for supplying the compressed air into a lower chamber of the air cylinder 27 on the side of the lower surface of the air piston 26. As illustrated, the compressed air is introduced into the lower chamber of the air cylinder 27 through a pressure-reducing valve 30. The pressure-reducing valve 30 acts as a relief valve for preventing damages of the apparatus due to excessive supply of the compressed air. The pressure-reducing valve 30 is designed to control a maximum air pressure of the compressed air to be applied to the air piston, as descried in detail later. Damages of a fastener due to excessive setting force thereto is also prevented by adequately controlling the maximum air pressure. The handle 3 is provided with a control valve (not shown) to be controlled by a trigger 31. Upon pulling the trigger 31, the compressed air from the compressor is introduced into the air cylinder 27. Upon releasing the trigger 31, the supply of the compressed air is discontinued. The structure of the control valve is well known, as disclosed in the aforementioned Publications 3 to 6, for example. Thus, the detailed description will be omitted.

The more detailed description will be made on the action of pulling the mandrel 7 in the rearward direction of the tool housing 2 through the movement of the hydraulic piston 15 caused by a pressurized oil obtained from the compressed air. When the compressed air is supplied to the air cylinder 27 through the inlet 29, the supplied compressed air acts on the lower surface of the air piston 26 to move the air piston 26 upward. This movement allows the ram 25 to be moved upward within the oil reservoir 22 to pressurize the working oil in the oil reservoir 22. The pressurized oil is introduced into the hydraulic chamber 19 of the hydraulic cylinder 17 through the passage 23. The introduced pressurized oil in the hydraulic chamber 19 acts to move the hydraulic piston 15 rearward within the tool housing 2. Thus, the pulling rod 18 connected with the hydraulic piston 15 is moved rearward, and the rotation rod 10 and the mandrel 7 are moved rearward in conjunction with the movement of the pulling rod 18. The pulling force of the mandrel 7 is equal to the pulling force of the hydraulic piston connected with the pulling rod 15, and is a product of the multiplication of the level of the oil pressure acting on the hydraulic piston 15 and the value of the pressure-receiving area of hydraulic piston 15. The oil pressure acting on the hydraulic piston 15 is obtained from the upward movement of the ram 25 in the oil reservoir 22. Because the ram 25 is directly connected with the air piston 26, the oil pressure acting on the hydraulic piston 15 is in direct proportion to the air pressure acting on the air piston 26. That is, The pulling force of the mandrel=(the oil pressure level)×(the value of the pressure-receiving area of the hydraulic piston).

Wherein the oil pressure level=(the air pressure level acting on the air piston)×[the pressure-receiving area of the air piston/the pressure-receiving area of the ram]=(the air pressure level acting on the air piston)×(the pressure intensification ratio).

As seen from the above formula, the pulling force of the mandrel 7 is in direct proportion to the air pressure acting on the air piston because each of the pressure-receiving area of the air piston, the pressure-receiving area of the ram and the pressure-receiving area of the hydraulic piston is constant in the specified setting apparatus.

According to the present invention, the pulling force of the mandrel 7 or a setting force is maintained at a desired constant level to adequately set a nut-type fastener such as a blind nut. For this purpose, means (33) for adjusting an air pressure which is to be applied to the air piston 26 and is proportional to the pulling force of the mandrel 7 is provided in association with the air cylinder 27. More specifically, there is provided an air-pressure setting valve 33 for adjustably presetting the air pressure of the compressed air to be applied to the air piston 26. The air-pressure setting valve 33 may be attached directly to the air cylinder section 5, or may be provided at another position of the setting apparatus, for example, in the handle 3 and associated with the air cylinder 27 through a passage, or may be provided separately from the setting apparatus and associated with the air cylinder 27 through a hose. When the compressed air accumulated in the air cylinder 27 is increased up to an air pressure equal to or grater than a preset air pressure level, the air-pressure setting valve 33 feeds the compressed air from the air cylinder 27 to the cylinder 13A of the completion valve activation assembly 13 to drive the completion valve activating piston 13C so as to change the completion valve 11 to the activated position. In response to the completion valve 11 changed to the activated position, the supply of the compressed air to the air cylinder 27 is discontinued (under the condition that the trigger 31 is pulled), and the compressed air is supplied to the air motor 9 to rotate the air motor 9 in the reverse direction. Since the supply of the compressed air to the air cylinder 27 is discontinued, the air piston 26 stops moving. Thus, at the preset air pressure level, the ram 25 is stopped from advancing in the oil reservoir 22, and the supply of the pressurized oil is discontinued. Then, the rearward movements of the hydraulic piston and the pulling rod 18 are stopped, and thus the mandrel 7 is stopped from being pulled axially. According to the above operations, the pulling force of the mandrel 7 is maintained at a predetermined level determined by the preset air pressure level to allow the pulling force of the mandrel 7 or a setting force to be maintained at a desired constant level. Thus, a fastener, such as a blind nut, can be adequately set to a workpiece only by presetting the air pressure at a level corresponding to a setting force for the workpiece once (or by only a single adjustment), irrespective of the variations in thickness of the workpiece and without any need for adjusting the stroke of the mandrel. Furthermore, instead of the adjustment of the ram or the oil pressure in the oil reservoir, the adjustment performed based on the air pressure in the air cylinder makes it possible to provide a facilitated adjusting operation and a simplified adjustment mechanism.

Figure 2:
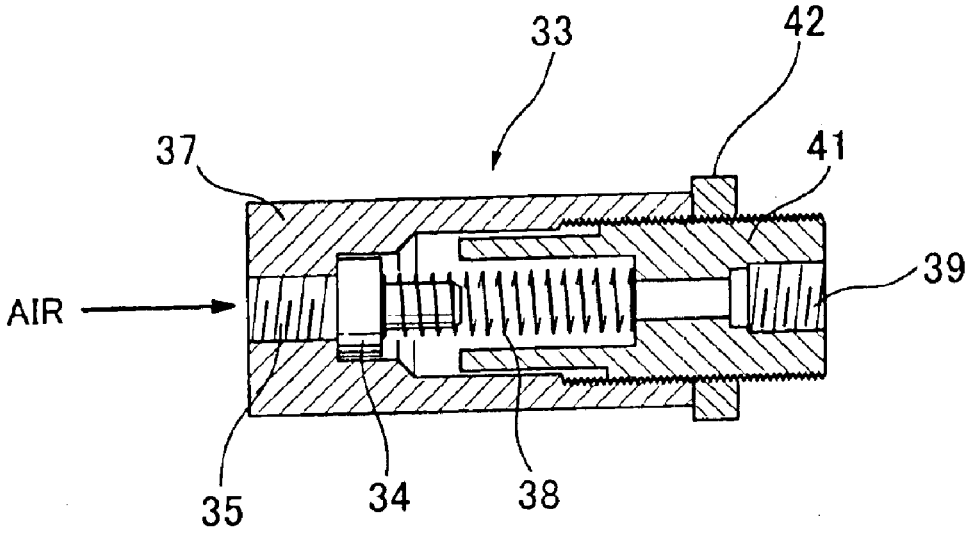
FIG. 2 is a sectional view of an air-pressure setting valve in the position where it prevents the compressed air from passing therethrough before an air presume is lower than a preset air pressure.
Figure 3:
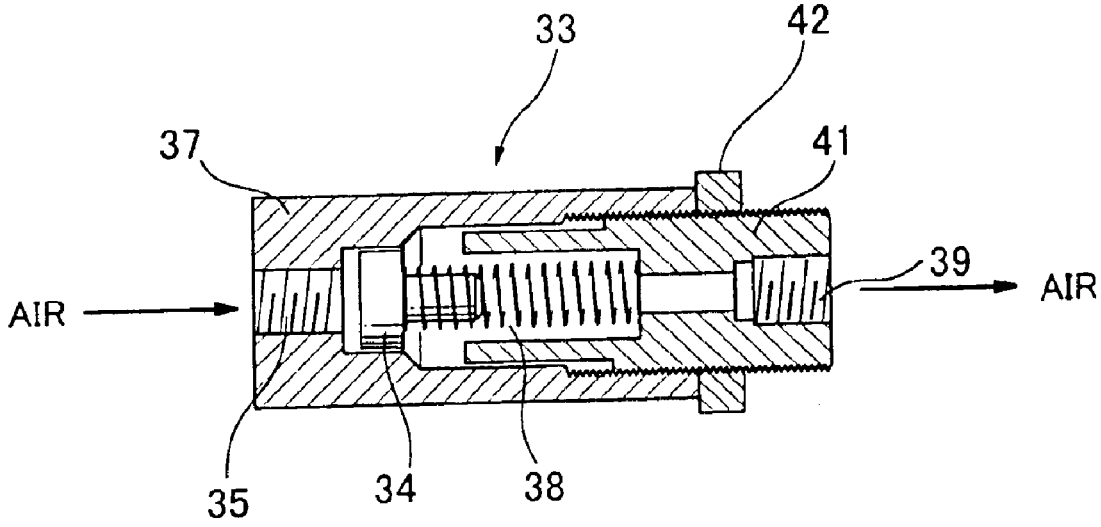
FIG. 3 is a sectional view of the air-pressure setting valve in the position where it allows the compressed air from passing therethrough.

The details of the air-pressure setting valve 33 will be described with reference to FIGS. 2 and 3. The air-pressure setting valve 33 comprises: a valve element 34; a valve housing 37 for receiving the valve element 34 therein and having an inlet 35 in fluid communication with the air cylinder 27; a spring 38 for pressing the valve element 34 onto the inlet 35 with a certain spring force to prevent the compressed air in the air cylinder 27 from being discharged; and a spring holder 41 for holding the spring 38 and having an outlet 39 for discharging the compressed air from the air cylinder 27. The spring holder 41 is attached to the valve housing 37 in such a manner that it is movable to adjustably preset the pressing force of the spring 38, for example, through threaded connection between the holder and the housing. With this structure, the air pressure to be supplied to the air cylinder 27 can be preset by presetting the pressing force of the spring 38. A lock nut 42 is threadedly connected with the spring holder 41, and the preset pressing force level of the spring 38 (or the adjusted position of the spring holder 41) can be fixed or locked after the adjustment. The valve element 34 in FIGS. 1 and 2 is in close contact with the inlet 35 to prevent the compressed air applied to the inlet 35 from passing therethrough. As shown in FIG. 3, when a higher air pressure of the compressed air than the pressing force of the spring 38 is applied to the inlet 35, the valve element 34 is moved away from the inlet 35, and the high-pressure air is discharged from the outlet 39 through a gap (not shown) around the valve element 34.

As shown in FIG. 1, a check valve 43 is provided in fluid communication with the inlet 35 and the outlet 39 of the air-pressure setting valve 33 in parallel with the air-pressure setting valve 33. After the completion of the operation of the completion valve activation assembly 13, the check valve 43 is operable to discharge the compressed air remaining in the cylinder 13A to help the completion valve activating piston 13C to return to its initial position in cooperation with the spring force of the spring 13B.

The compressed air discharged from the outlet 39 of the air-pressure setting valve 33 is fed to the completion valve activation assembly 13. When the air pressure in the air cylinder 27 reaches the preset air pressure level, the compressed air in the air cylinder 27 is fed from the air-pressure setting valve 33 to the completion valve activation assembly 13, and then the completion valve activation assembly 13 acts on the completion valve 11 to rotate the air motor 9 in the reverse direction and thereby rotate the mandrel 7 in the reverse direction. As described above, at the preset air pressure level, the operation of pulling the mandrel 7 has been discontinued, and the fastener, such as a blind nut, has been set to the workpiece. The threaded connection between the mandrel 7 and the fastener, such as a blind nut, set to the workpiece can be released by rotating the mandrel 7 in the reverse direction.

Further, damage to the fastener due to excessive setting force can also be prevented by the adjustability of the pressure-reducing valve 30. For example, if the operation of the air-pressure setting valve 33 has a certain delay due to insufficient response of the spring 38, a higher air pressure than the preset air pressure is intended to be accumulated in the air cylinder 27, resulting in an excessive pulling force in the mandrel 7. The excessive setting force is apt to cause damages in a fastener such as a blind nut, particularly, if it has a low strength. In order to prevent such damages, the pressure-reducing valve 30 is designed such that it can be activated at an air pressure slightly higher than a preset air pressure level adjusted by the air-pressure setting valve 33. The pressure-reducing valve 30 can control the maximum air pressure in the air cylinder, in such a manner that the pressure-reducing valve 30 serves to allow the mandrel 7 to be pulled based on the air pressure slightly higher than the preset air pressure adjusted by the air-pressure setting valve 33 but the pressure-reducing valve 30 serves to discharge the compressed air to the air cylinder 27 if the air pressure excesses the maximum air pressure. If the maximum air pressure be controlled by a compressed-air supply source, the resulting air pressure reduction in entire compressed air will cause a undesirably deteriorated output of the air motor 9.

The operation of the setting apparatus 1 will be schematically described in conjunction with an example in which a blind nut is set to a workpiece. The blind nut is formed as a one-piece component made of plastically deformable metal or the like. The blind nut comprises a hollow internally threaded portion, a tubular portion extending continuously from the internally threaded portion, and a flange provided at the end of the tubular portion and formed with an opening. The blind nut is set to a workpiece by inserting the tubular portion into a mounting hole of a workpiece to expandingly deform a part of the tubular portion on the opposite side of the flange so as to clamp the workpiece between the expandingly deformed portion and the flange. Such an operation is disclosed, for example in FIG. 2B of the aforementioned Publication 1. In the operation of setting the blind nut using the setting apparatus, the blind nut is attached to the mandrel 7 before the trigger 31 is pulled. This operation can be performed such that an operator presses the blind nut against the mandrel 7 to push the mandrel 7 into the nose 6. When the mandrel is pushed into the nose 6, compressed air is supplied to the air motor 9 through the completion valve 11 which is in the initial position, and the air motor 9 rotates the mandrel in the forward direction to threadedly connect the blind nut with the mandrel 7. After the mandrel 7 is fully screwed into the blind nut to bring the blind nut into contact with the end surface of the nose, the nut acts to return the mandrel 7 gradually to its protrusive position. When the mandrel 7 is returned to the protrusive position where it protrudes from the nose 6 at a predetermined length, the supply of the compressed air to the air motor 9 is discontinued, and the air motor 9 is stopped while maintaining the threaded connection between the blind nut and the mandrel 7.

Then, the operator inserts the tubular portion of the blind nut into a mounting hole of the workpiece such as a panel, and then pulls the trigger 31. By pulling the trigger 31, the compressed air is supplied to the air cylinder 27 through the control valve (not shown) of the handle 3 and the pressure-reducing valve 30, to move the air piston 26 upward. In conjunction of the upward movement of the air piston 26, the ram 25 is moved upward, and the resulting pressurized oil is supplied into the hydraulic chamber 19 of the hydraulic cylinder 17 so that the hydraulic piston 15 is moved rearward. In conjunction with the rearward movement of the hydraulic piston 15, the mandrel 7 is pulled through the pulling rod 18, and the internally threaded region of the tubular portion of the blind nut attached to the mandrel 7 is strongly pulled together with the mandrel 7. Through this pulling operation, a portion of the tubular portion of the blind nut is expandingly deformed, and the workpiece is clamped between the expandingly deformed portion and the flange. Thus, the blind nut is set to the workpiece. While conventional setting apparatus is designed to adjust the pulling length or stroke of the mandrel, the pulling force in the present invention is determined by the preset air pressure level adjusted by the air-pressure setting valve 33, as described above. Thus, when the blind nut is set, and the air pressure reaches the preset air pressure level, the movement of the mandrel 7 is stopped, and the mandrel 7 is rotated in the reverse direction to allow the apparatus to be disengaged from the blind nut set to the workpiece. Then, upon releasing the trigger, the operation of setting apparatus 1 is discontinued. The compressed air of the air cylinder 27 is discharged to atmosphere, and the air piston 26 and the ram 25 are returned to its top position or initial position.

Figure 4:
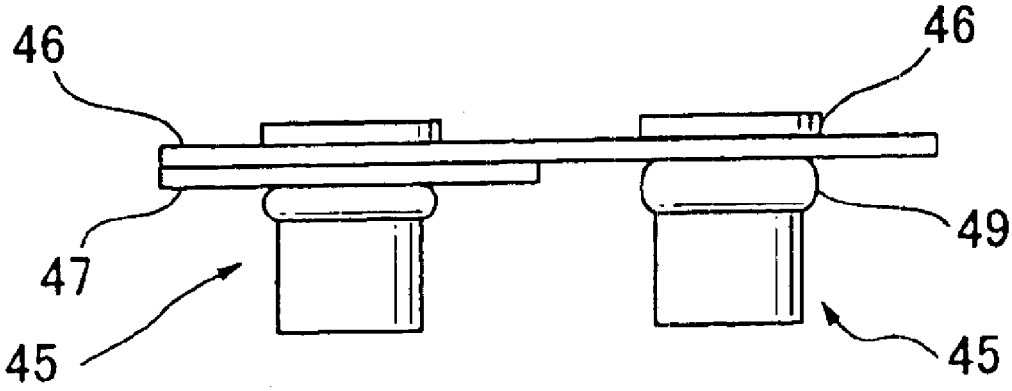
FIG.4 (PRIOR ART)
FIG. 4 is a view showing blind nuts set using a conventional fastener setting apparatus.
Figure 5:
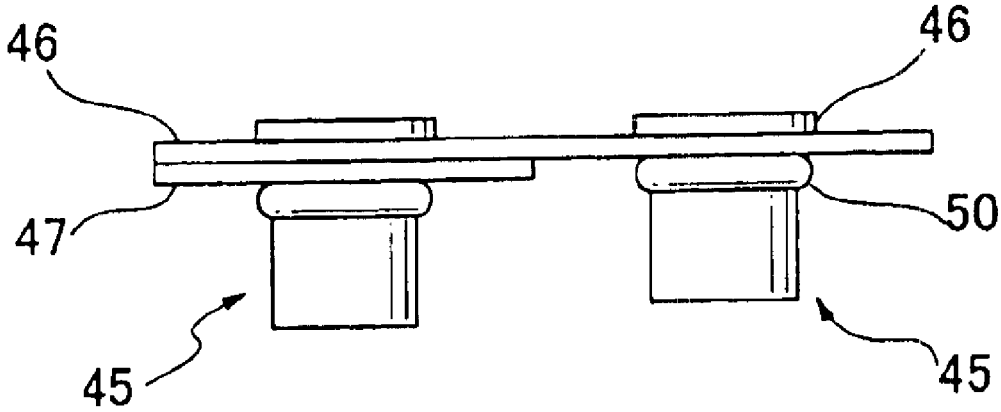
FIG. 5 is a view showing blind nuts set using a fastener setting apparatus according to the present invention.

FIG. 4 shows blind nuts 46 set to a workpiece using the stroke adjusting type of conventional setting apparatus. The blind nut 45 on the left side is adequately set to a pair of workpieces 46, 47. However, in the blind nut 45 on the right side, due to the reduced number of workpieces or the insufficient total thickness relying on only the workpiece 46, the expandingly deformed portion 49 of the blind nut 45 is not adequately formed, resulting in deteriorated setting force. FIG. 5 shows blind nuts 45 set to the workpiece using the setting apparatus 1 according to the present invention. The left blind nut 45 is adequately set to the pair of workpieces 46, 47. In the right blind nut 45, an expandingly deformed portion 50 is also adequately formed and a high setting force is achieved therein. Because the pulling force of the mandrel 7 engaged with the blind nut is adequately determined by the preset air pressure level adjusted by the air-pressure setting valve 33.

Figure 6:
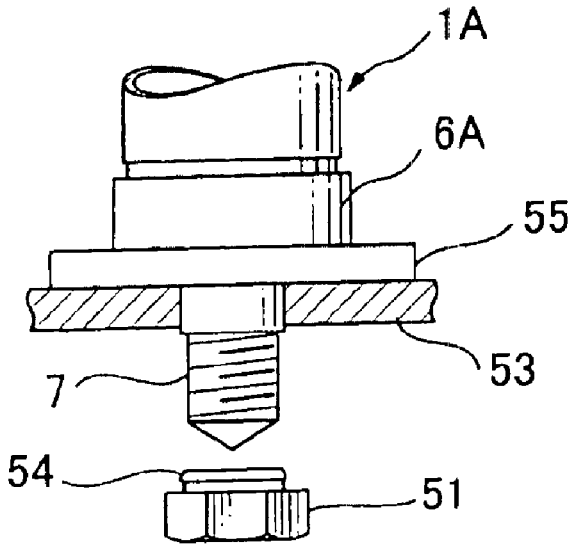
FIG. 6 is a view showing the state before a press nut is attached to a mandrel in a process of setting the press nut using a fastener setting apparatus according to the present invention.
Figure 7:
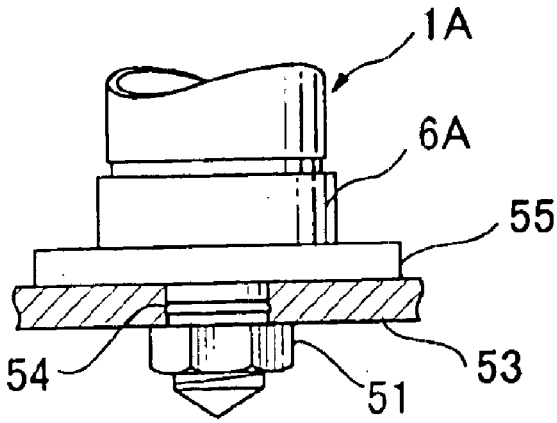
FIG. 7 is a view showing the state after the press nut in FIG. 6 is set to the workpiece.
Figure 8:
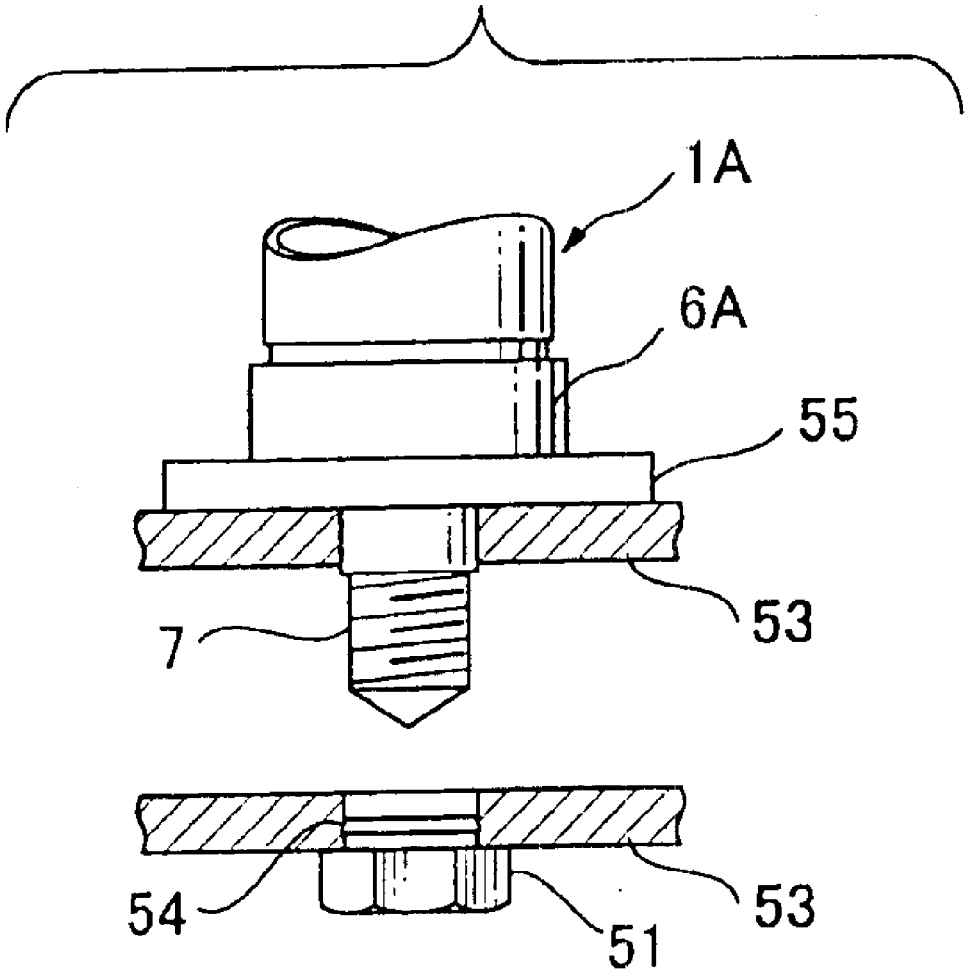
FIG. 8 is a view showing the state when the setting apparatus in FIG. 7 is disengaged from the press nut.

FIGS. 6 to 8 show a procedure for setting a press nut 51 to a workpiece 53 using the setting apparatus of the present invention. As shown in FIG. 6, differently from setting of blind nuts, upon setting of the press nut 45, the mandrel 7 of the setting apparatus 1A is penetratingly inserted into a mounting hole of the workpiece 53, and the press nut 51 on the opposite side with respect to the workpiece 53 is threadedly connected therewith. The mandrel 7 is pushed toward the nose 6A by the press nut 51 aligned with the mandrel 7 while positioning an insertion portion of the press nut 51 toward the mandrel 7. Thus, the air motor rotates in the forward direction to rotate the mandrel 7 in the forward direction, so that the press nut 53 can be threadedly connected with the mandrel 7. When the insertion portion 54 is brought into contact with the workpiece 53, the rotation is discontinued. Then, upon pulling the trigger, the mandrel 7 is pulled, the insertion portion 54 bites into the mounting hole of the workpiece as shown in FIG. 7, and thus the press nut 51 is fixed to the workpiece 53. At the preset air pressure level, the pulling operation of the mandrel 7 is discontinued, and the mandrel 7 is rotated in the reverse direction to allow the mandrel 7 to be disengaged from the press nut set to the workpiece (see FIG. 8). The operation of the setting apparatus can be discontinued by releasing the trigger. Although a press nut is typically set by pushing it into a mounting hole of a workpiece, in the setting process using the setting apparatus of the present invention, a press nut is set by pulling it into a mounting hole of a workpiece, as illustrated. Generally, in the setting process for press nuts, it is required to adequately adjust the insertion force. In the setting process using the setting apparatus of the present invention, the insertion force is identical to the pulling force of the mandrel, and thus the pulling force of the mandrel can be adjusted using the air-pressure setting valve to adequately set a press nut to a workpiece. Thus, in the process of setting a press nut, it is desired to attach a plate 55 to be seated onto a workpiece, at the front end of the nose 6A of the setting apparatus 1A.

According to the present invention, a nut-type fastener can be adequately set to a workpiece having a large variation in thickness, by using a single setting apparatus and by only a single adjustment. When the air pressure in the air cylinder reaches a preset air pressure level, the air-pressure setting valve feeds the compressed air from the air cylinder to the completion valve activation assembly to activate the completion valve so as to stop the hydraulic piston from axially pulling the mandrel. Thus, the need for adjusting the stroke of the mandrel can be eliminated. Further, since the pulling force of the mandrel can be maintained at a constant level even if a workpiece has a different thickness, Thus, a fastener, such as a blind nut, can be adequately set to a workpiece only by presetting the air pressure at a level corresponding to a setting force for the workpiece once (or by only a single adjustment) irrespective of the variation in thickness of the workpiece, and the pulling force of the mandrel directly associated with the setting force allows the setting force to be stably maintained at a high level. Furthermore, instead of the adjustment of the ram or the oil pressure in the oil reservoir, the adjustment performed based on the air pressure in the air cylinder makes it possible to provide a facilitated adjusting operation and a simplified adjustment mechanism.

I claim:

1. A fastener setting apparatus for setting, to a workpiece, a nut-type fastener such as a blind nut which is formed as a hollow internally threaded tubular body with one end having a flange or a larger diameter portion, said fastener setting apparatus comprising: a mandrel adapted to be screwed into said fastener; a hydraulic cylinder for receiving therein a hydraulic piston for axially pulling said mandrel; an oil reservoir for containing oil to be supplied to said hydraulic cylinder; a ram reciprocatably disposed in said oil reservoir; an air cylinder for receiving therein an air piston which allows said ram connected thereto to be reciprocatingly advanced and retracted in said oil reservoir, wherein upon triggering, compressed air is supplied to said air cylinder to move said air piston to advance said ram into said oil reservoir to thereby supply oil from said oil reservoir to said hydraulic cylinder so that said hydraulic piston is moved to pull said mandrel, whereby said fastener threadedly connected with said mandrel is set to said workpiece, said fastener setting apparatus further comprising:

an air-pressure setting valve for adjustably presetting the air pressure of the compressed air to be supplied in said air cylinder and applied to said air piston;

a completion valve operable to discharge the compressed air from said air cylinder outside to stop the movement of said hydraulic piston; and completion valve activation assembly for enabling said completion valve to be operated, wherein when the air pressure in said air cylinder reaches the preset air pressure level, said air-pressure setting valve is operated to feed the compressed air from said air cylinder to said completion valve activation assembly so as to stop said hydraulic piston from axially pulling said mandrel at said preset air pressure.

2. The apparatus as defined in claim 1, wherein said air-pressure setting valve includes:

a valve element;

a valve housing for receiving said valve element therein and having an inlet in fluid communication with said air cylinder;

a spring for pressing said valve element against said inlet with a certain spring force to prevent the compressed air in said air cylinder from being discharged; and a spring holder attached to said valve housing for holding said spring and having an outlet for releasing the compressed air, said spring holder being attached to said valve housing in such a manner that the pressing force of said spring can be changed, whereby the air pressure to be supplied to said air cylinder is preset according to the change of the pressing force of said spring.

3. The apparatus as defined in claim 2, wherein said completion valve activation assembly includes a cylinder for receiving the compressed air from said air-pressure setting valve, and a completion valve activating piston for moving said completion valve to its activated position, wherein a check valve is arranged in parallel with said air-pressure setting valve to discharge the compressed air remaining in said cylinder of said completion valve activation assembly to said air cylinder after the completion of the operation of said completion valve activation assembly, so as to return said completion valve activating piston to its initial position.

4. The apparatus as defined in claim 2, further including: an air motor adapted to rotate said mandrel about its axis in a forward direction to allow said nut-type fastener to be threadedly connected with said mandrel and in a reverse direction to allow said threadedly connected fastener to be disengaged from said mandrel, wherein said completion valve is operable in its initial position to rotate said air motor in said forward direction, and operable in the activated position to rotate said air motor in said reverse direction, wherein when the air pressure onto the air piston reaches said preset air pressure level, said completion valve is moved to said activated position to rotate said air motor in said reverse direction so that said fastener threadedly connected with said mandrel is disengaged therefrom.

5. The apparatus as defined in claim 1, wherein said fastener is a blind nut or a press nut.

* * * * *